United States Patent [19]

Saiki et al.

[11] Patent Number: 4,917,290

[45] Date of Patent: Apr. 17, 1990

[54] SHOE TOTE BAG

[76] Inventors: Shinzo Saiki, 10 Crystal Dr., Great Neck, N.Y. 11021; Kuniaki Nomura, 61 Jones St., New York, N.Y. 10014

[21] Appl. No.: 385,181

[22] Filed: Jul. 26, 1989

[51] Int. Cl.[4] ..... B65D 5/48

[52] U.S. Cl. ..... 229/112; 229/117.14; 229/120.03; 229/120.09

[58] Field of Search ..... 229/52 B, 112, 120.03, 229/120.09, 148, 923; 206/602

[56] References Cited

U.S. PATENT DOCUMENTS

| | | | |
|---|---|---|---|
| 2,923,455 | 2/1960 | Tingley | 229/52 B |
| 3,092,301 | 6/1963 | Selle | 229/120.09 |
| 3,099,380 | 7/1963 | Nathan | 229/52 B |
| 3,341,103 | 9/1967 | May | 229/120.09 |
| 3,357,543 | 12/1967 | Taggart | 229/120.09 |
| 3,397,771 | 8/1968 | Fogle | 229/120.09 |
| 3,677,458 | 7/1972 | Gosling | 229/52 B |
| 4,244,508 | 1/1981 | Schulman | 229/923 |
| 4,256,223 | 3/1981 | Pawlowski | 229/120.09 |
| 4,485,926 | 12/1984 | Lenzmeier | 229/120.03 |
| 4,618,090 | 10/1986 | Cortellucci | 229/120.09 |

FOREIGN PATENT DOCUMENTS

| | | | |
|---|---|---|---|
| 1097283 | 3/1981 | Canada | 229/112 |
| 114165 | 8/1984 | European Pat. Off. | 229/120.03 |

OTHER PUBLICATIONS

PKG 320, Packaging Materials Required Readings; School of Packaging, Summer 1977, p. 33.

*Primary Examiner*—Gary Elkins
*Attorney, Agent, or Firm*—Michael Ebert

[57] ABSTRACT

A rigid shoe tote bag formed from a single corrugated board blank that is die-cut and scored with fold lines to define interhinged twin shoe boxes in back-to-back relation, each box having a back panel with a slotted upper section forming the handle of the bag. Each compartment further includes a first side panel, a front panel and a second side panel having an extension flap which is joined to the back panel to form the body of the box. The side panels and the front panels are provided at either end with closure flaps which when folded in and locked enclose the body of the box.

4 Claims, 3 Drawing Sheets

Fig. 3.
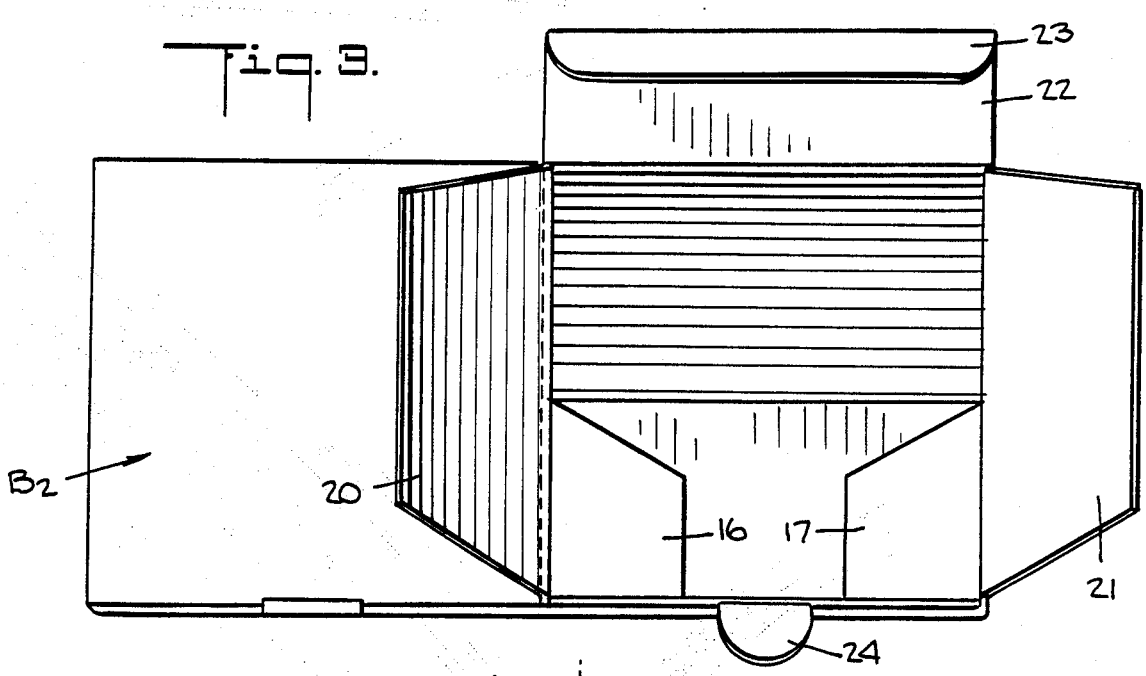
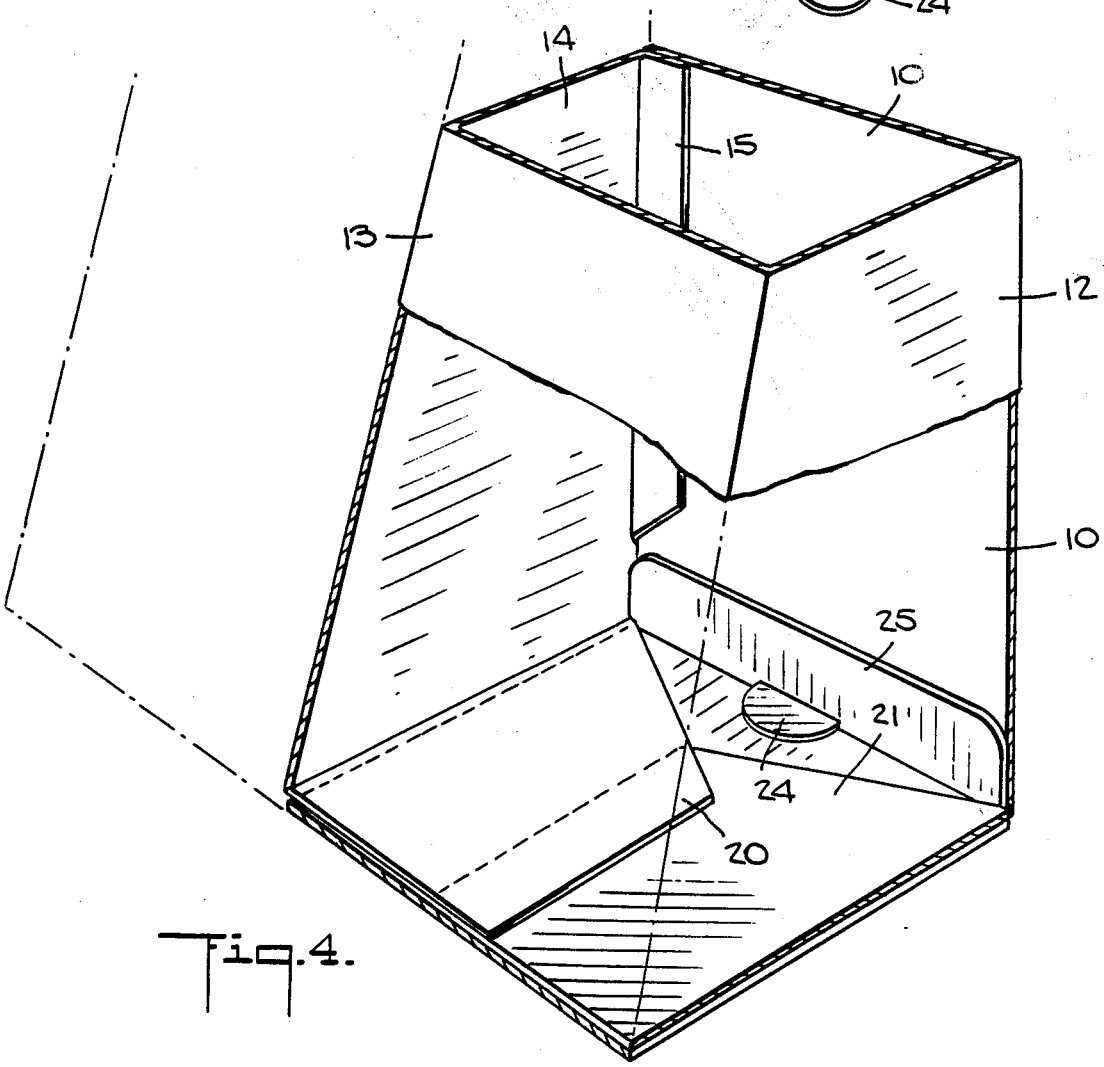
Fig. 4.

SHOE TOTE BAG

BACKGROUND OF INVENTION

1. Field of Invention:

This invention relates generally to shoe boxes, and more particularly to a rigid shoe tote bag formed by interhinged twin shoe boxes in back-to-back relation provided with a handle.

2. Status of Prior Art:

The manner in which an article purchased in a retail establishment is thereafter hand carried home by the purchaser reflects on the establishment, for it may act to enhance or diminish its prestige, depending on how the article is packaged for this purpose. If, for example, a costly article of high quality is carried home in an ordinary shopping bag provided by the store and having the name of the store imprinted thereon, this does not make a favorable impression on those who see the bag. Because the bag is commonplace, the impression gained is that the store whose name appears on the bag carries articles of ordinary quality.

Those stores which are sensitive to the correlation that exists in the minds of potential customers between the quality of its goods and the manner in which these goods are hand carried by purchasers pay a great deal of attention to their shopping bag design. Stores recognize that shopping bags represent, as it were, a walking advertisement, and exercise as much care in bag design as they do in preparing an ad for display in a quality publication.

Shoes represent a difficult problem in this respect, for they are normally stored in shoe boxes, each housing a pair of shoes. In the typical retail shoe store or boutique where a large inventory must be maintained of shoes in different sizes and styles, the shoe boxes are stacked on shelves. When a customer selects and purchases a particular pair of shoes, the customer is then asked how he or she would like to carry away the shoes.

If the customer would prefer the smallest possible package, the shoes are then placed in a plastic pouch having a drawstring which also functions as the handle. While such pouches may be attractively designed and reflect well on the store, they offer no protection to the shoes. Where the shoes are of the high fashion type and are relatively delicate, a pouch is not a suitable carrier therefor.

In a conventional shoe box which accommodates a pair of shoes, each shoe in the pair is separately wrapped in tissue paper before being placed in the box to prevent the shoes from rubbing against each other. But in a pouch, unless the shoes are separately wrapped before being inserted therein, one shoe may abrade the other in the course of transit, with possible damage to a fine leather finish.

Alternatively, after being purchased, the boxed shoes may be covered with an attractive wrapper to which a handle is tied. But this is a time-consuming procedure. Or the boxed shoes may be placed in an attractive shopping bag. Although this offers better protection than a pouch, it still leaves something to be desired, for the bag for this purpose must be large enough to receive the shoe box, and the resultant carrier is cumbersome and awkward to carry.

The need exists, therefore, for a protective hand carrier for shoes which is compact and attractive, and which is free of the drawbacks found in prior carriers for this purpose.

The need also exists for a hand carrier which can be used when the owner wishes to take along an extra pair of shoes to a dance or other social occasion. If the owner is fashionably dressed for this occasion, it would be unseemly for the owner to carry a shoe box under his arm.

SUMMARY OF INVENTION

In view of the foregoing, the main object of this invention is to provide a rigid shoe tote bag serving as a carrier for a pair of shoes, the bag being constituted by twin boxes each housing a shoe.

More particularly, an object of this invention is to provide a rigid shoe tote bag which is formed from a single bank of corrugated board, whereby the bag is inexpensive to manufacture.

A significant advantage of the invention is that each shoe in the pair occupies its own protective box and is isolated from the other shoe, so that despite the fact that the two shoes are close together, they do not rub against each other in transit.

Another advantage of the invention is that the rigid tote bag is usable not only to carry shoes home from the store in which they were purchased, but also to carry an extra pair of shoes to a social occasion.

Briefly stated, these objects are attained in a rigid shoe tote bag formed from a single corrugated board blank that is die-cut and scored with fold lines to define interhinged twin shoe boxes in back-to-back relation, each box having a back panel with a slotted upper section forming the handle of the bag. Each compartment further includes a first side panel, a front panel and a second side panel having an extension flap which is joined to the back panel to form the body of the box. The side panels and the front panels are provided at either end with closure flaps which when folded in and locked enclose the body of the box.

BRIEF DESCRIPTION OF DRAWINGS

For a better understanding of the invention as well as other objects and further features thereof, reference is made to the following detailed description to be read in conjunction with the accompanying drawing, wherein:

FIG. 3 is a bottom view of the tote bag in its carrier mode with the closure flaps of one of the twin boxes unfolded;

FIG. 4 is a cut-away view of one of the boxes; and

DESCRIPTION OF INVENTION

The Tote Bag:

Referring now to FIGS. 1 to 4, there is shown a rigid tote bag in accordance with the invention, the bag being constituted by interhinged twin boxes $B_1$ and $B_2$ accommodating the respective shoes $S_1$ and $S_2$ of a matched pair thereof. The dimensions of the boxes are sufficient to accommodate the full range of normal adult shoe sizes. In practice, if the tote bag is intended only for children's shoes, the box dimensions may be smaller.

Figure 1:
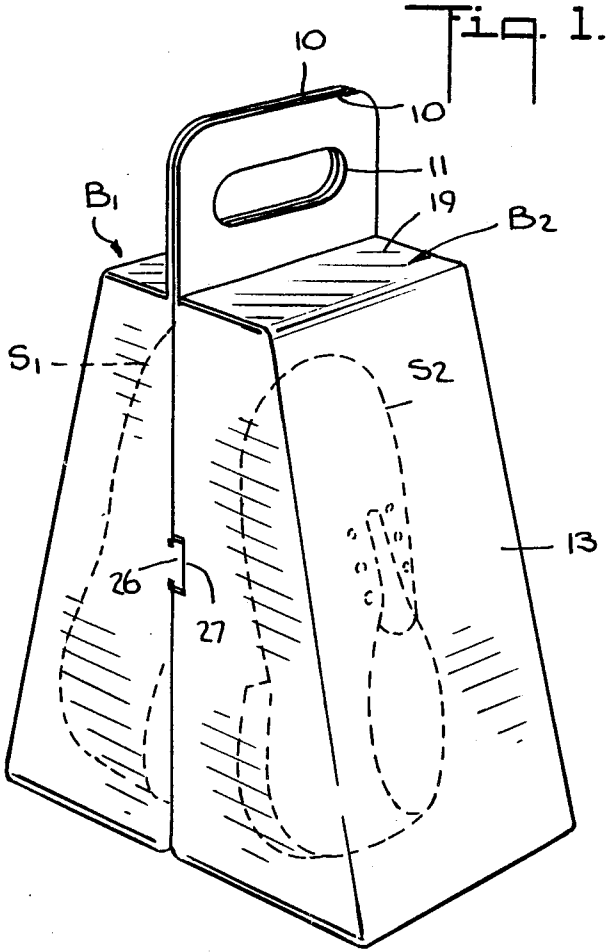
FIG. 1 is a perspective view of a rigid tote bag in accordance with the invention, as seen in its carrier mode in which the interhinged twin shoe boxes are in back-to-back relation.

Each box includes a back panel 10 whose upper section has an oblong notch 11 cut therein so that when the tote bag is in its carrier mode and the boxes are then in back-to-back relation, as shown in FIG. 1, panels 10 are superposed to form a handle in which the user inserts his fingers in notch 11.

Each box further includes a first side panel 12, a front panel 13 and a second side panel 14 provided with an extension flap 15 that is bonded to back panel 10 to form the body of the box. Each box is provided at the upper end of its body with side closure flaps 16 and 17 and a front closure flap 18, closure flap 18 having a tongue 19.

Figure 2:
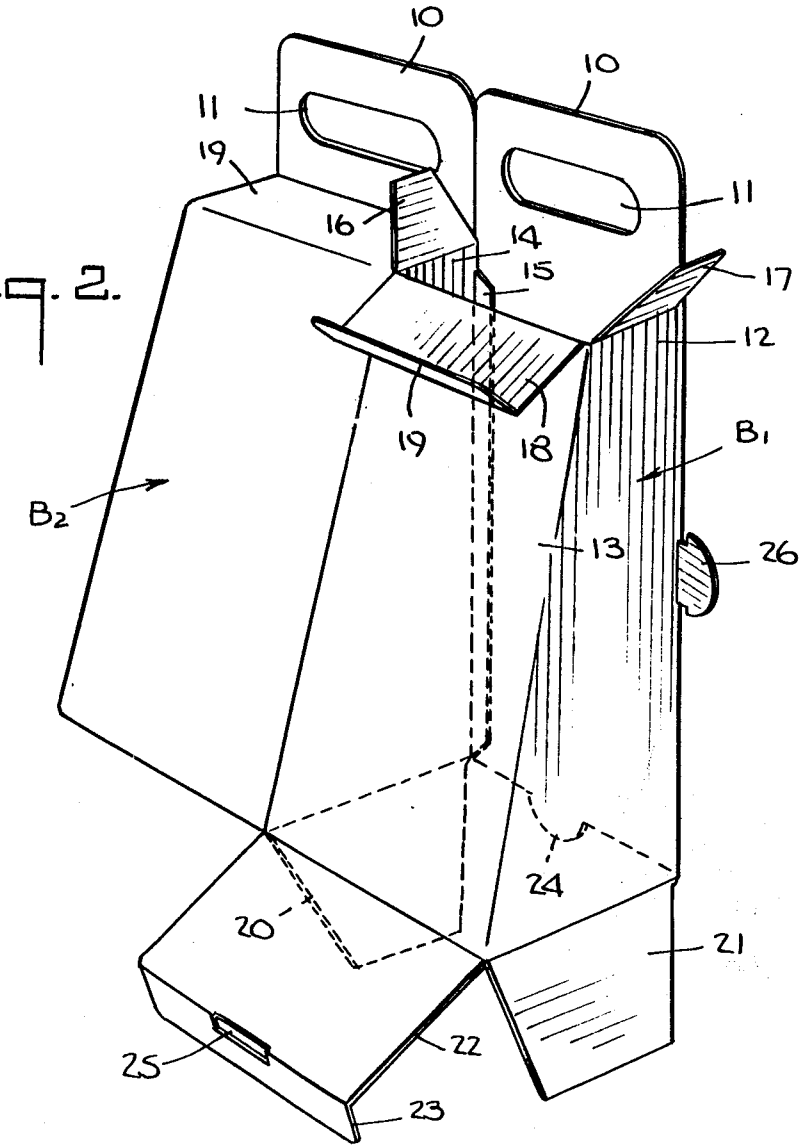
FIG. 2 shows the tote bag in its loading mode in which the shoe boxes are in side-by-side relation.

FIG. 2 shows the tote bag in its loading mode with boxes $B_1$ and $B_2$ then in side-by-side relation. This figure shows side flaps 16 and 17 and front flap 18 of box $B_1$ unfolded to open the upper end of this box. To close the upper end of this box, flaps 16 and 17 are first folded in, and flap 18 is folded in to overlie flaps 16 and 17. Tongue 19 is then forced in against back panel 10 to enclose the upper end of the box.

As best seen in FIGS. 3 and 4, the bottom end of the body of each box is provided with side closure flaps 20 and 21 and a front closure flap 22 having a tongue 23 extending therefrom. To close the bottom end after the shoes are inserted in the twin boxes, flaps 20 and 21 are folded in and flap 22 is folded thereover, the bottom being locked closed by a locking tab 24 on back panel 10, which, after tongue 23 is forced against back panel 10, is inserted into a complementary notch 25 cut in tongue 23 at its junction with flap 22. To remove a shoe from a box, one has only to unfold the flaps at the bottom end.

To maintain the boxes in back-to-back relation in the tote mode, a foldable locking tab 26 cut in back panel 10 of box $B_1$ at its junction with side panel 12 is inserted in a complementary slot 27 and in back panel 10 of box $B_2$ at its junction with side panel 12 Because corrugated board is compressible, this makes it possible to force the tongues in against the back panel and to thereby hold the flaps closed.

The Blank

Figure 5:
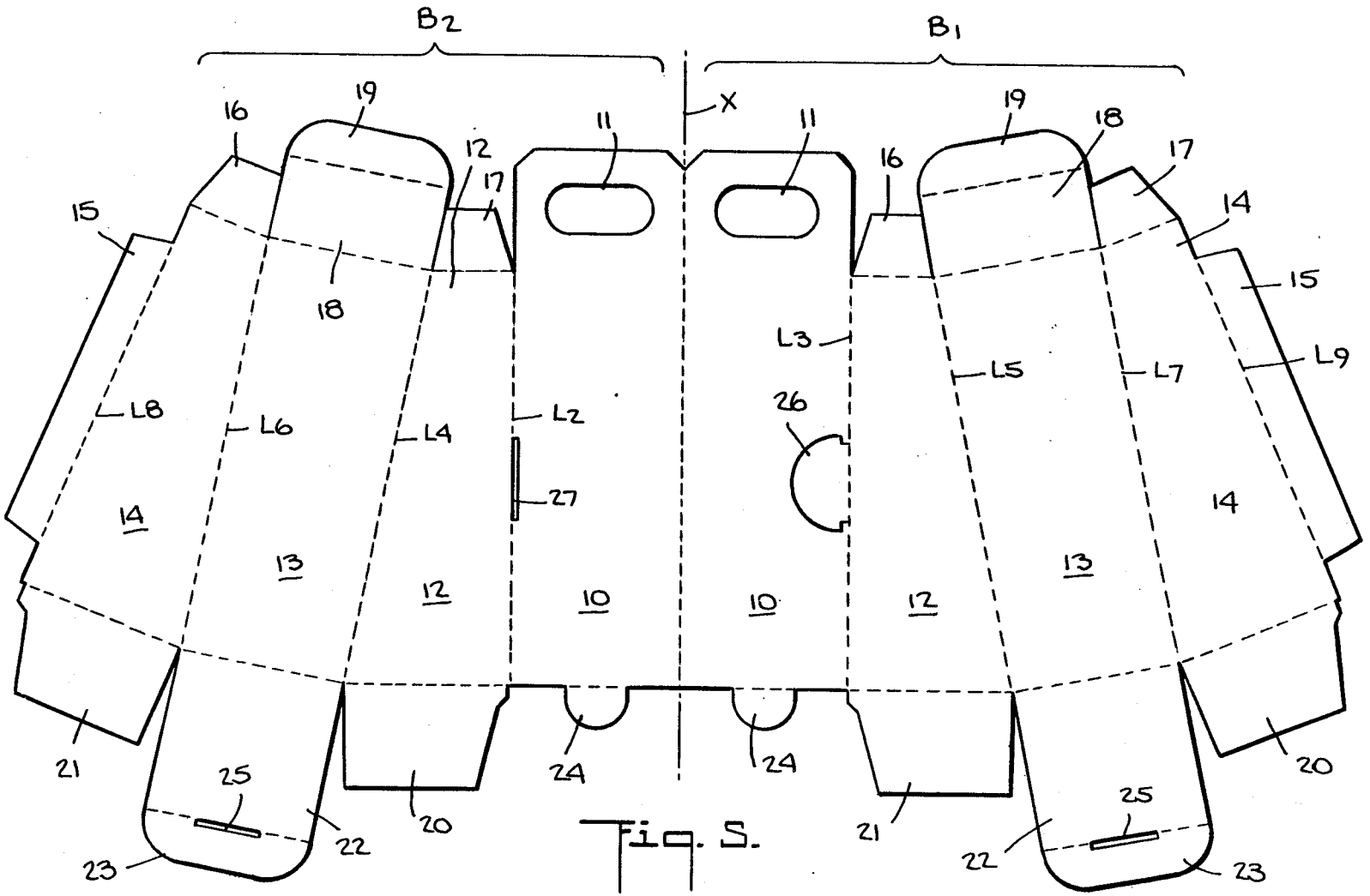
FIG. 5 is a plan view of the blank from which the tote bag is made.

As shown in FIG. 5, the tote bag is fabricated from a single blank formed of single-ply, corrugated board material or of foam-plastic sheeting having similar structural properties. The blank is die-cut to define the two sets of panels that form boxes $B_1$ and $B_2$ with respect to an axis of symmetry X, this axis being defined by fold line $L_1$ that is scored at the center of the blank.

Scored parallel to fold line $L_1$ on either side thereof are fold lines $L_2$ and $L_3$ which define the back panels 10 of boxes $B_1$ and $B_2$. The form of the boxes shown is that of truncated, four-sided wedges; hence score lines $L_4$ and $L_5$ which define the first side panels 12 of the boxes are inclined relative to lines $L_2$ and $L_3$. The advantage of the wedge form is that the twin boxes are broader at their bottoms than at their tops, hence the tote bag when resting on a surface is stable and not easily overturned. However, in practice the boxes may be in parallelpiped form, in which case all fold lines will be parallel to each other.

Front panels 13 are defined by fold lines $L_6$ and $L_7$ scored in the blank parallel to lines $L_4$ and $L_5$, respectively. The second side panels 14 are defined by score lines $L_8$ and $L_9$ which are inclined relative to lines $L_6$ and $L_7$. Lines $L_8$ and $L_9$ are the fold lines for extension flaps 15. The top closure flaps 16, 17, 18 and tongue 19 are defined by fold lines scored in the blank, as are the bottom closure flaps 20, 21, 22 and tongue 23.

In practice, a thin facing paper or plastic sheet may be laminated to the outer face of the blank and imprinted with the name of the store selling the shoes and decorative graphics to render the tote bag highly attractive. The facing sheet may also be of waterproof, high-strength sheet material to render the tote bag reusable, so that it may not only be used to carry purchased shoes home but as a carrier for taking along an extra pair of shoes.

While there has been shown and described a preferred embodiment of a shoe tote bag in accordance with the invention, it will be appreciated that many changes and modifications may be made therein without, however, departing from the essential spirit thereof.

I claim:

1. A shoe tote bag for carrying a pair of shoes comprising a single blank that is die-cut and scored with fold lines to define when the blank is folded on the fold lines interhinged twin shoe boxes in back-to-back relation, each box having a back panel, a first side panel, a front panel and a second side panel, each box having an extension flap which is joined to the back panel to form a box having the form of a truncated, four-sided wedge adapted to accommodate one shoe of said pair thereof, said side panels and the front panel of each box having closure flaps at either end to enclose the box, the back panel of each box being provided with a slotted upper section which extends above the box to form a handle when the back panels of the twin boxes are superposed, and releasable means to retain said boxes in back-to-back relation.

2. A tote bag as set forth in claim 1, wherein said means are constituted by a locking tab in one of the twin boxes that is inserted in a complementary slot in the other box to maintain the boxes in back-to-back relation.

3. A tote bag as set forth in claim 1, wherein said blank is formed of single-ply corrugated board.

4. A tote bag as set forth in claim 1, wherein the closure flap of the front panel at either end of each box is provided with a tongue which is insertable against the back panel.

* * * * *